US011322323B1

(12) United States Patent
Cantolino

(10) Patent No.: US 11,322,323 B1
(45) Date of Patent: May 3, 2022

(54) MAGNETIC SWITCH ASSEMBLY

(71) Applicant: Christopher Cantolino, Bradenton, FL (US)

(72) Inventor: Christopher Cantolino, Bradenton, FL (US)

( * ) Notice: Subject to any disclaimer, the term of this patent is extended or adjusted under 35 U.S.C. 154(b) by 134 days.

(21) Appl. No.: 16/873,260

(22) Filed: Mar. 6, 2020

Related U.S. Application Data

(60) Provisional application No. 62/856,620, filed on Jun. 3, 2019.

(51) Int. Cl.

| | |
|---|---|
| ***H01H 36/00*** | (2006.01) |
| ***H01H 23/16*** | (2006.01) |
| ***H01H 23/12*** | (2006.01) |
| ***H01H 5/18*** | (2006.01) |
| *H01H 23/02* | (2006.01) |

(52) U.S. Cl.
CPC ..... *H01H 36/0073* (2013.01); *H01H 23/162* (2013.01); *H01H 5/18* (2013.01); *H01H 23/02* (2013.01); *H01H 2225/014* (2013.01)

(58) Field of Classification Search
CPC ..... H01H 36/0073; H01H 2225/014; H01H 23/162; H01H 35/18; H01H 23/02; H01H 5/18
USPC ..... 335/205–207
See application file for complete search history.

(56) References Cited

U.S. PATENT DOCUMENTS 3,052,778 A * 9/1962 Kathe ..... H01H 36/0073 335/207
3,273,091 A * 9/1966 Wales, Jr. ..... H01H 36/0073 335/207
3,743,980 A * 7/1973 Steiner ..... H01H 5/02 335/205
4,489,297 A * 12/1984 Haydon ..... H01H 36/0073 200/404

* cited by examiner

*Primary Examiner* — Bernard Rojas
(74) *Attorney, Agent, or Firm* — Arthur W. Fisher, III

(57) ABSTRACT

A magnetic switch assembly comprising a toggle bar and a switch actuator each rotatable between a first position and a second position, at least one set of magnets including a first magnet mounted on the proximal end portion of the toggle bar and a second magnet mounted on the proximal end portion of the switch actuator and a corresponding pair of electrical contacts including a first electrical contact coupled to a first electrical conductor and a second electrical contact coupled to a second electrical conductor wherein the toggle bar is normally bias in the first position when the switch actuator is in the first position with the first magnet disposed in spaced relationship relative to the second magnet when each is in the first position and having a gap therebetween such that the first electrical contact and the second electrical contact engage each other to complete an electrical circuit between the first electrical conductor and the second electrical conductor and when the switch actuator is moved from the first position to the second position decreasing the gap between the first magnet and the second magnet as the magnetic attraction therebetween overcomes the toggle bar bias disengaging the second electrical contact from the first electrical contact to create an open electrical circuit.

19 Claims, 6 Drawing Sheets

MAGNETIC SWITCH ASSEMBLY

CROSS REFERENCE

This is a nonprovisional utility application of provisional application Ser. No. 62/856,620 filed Jun. 3, 2019.

BACKGROUND OF THE INVENTION

Field of the Invention

A magnetic toggle switch to selectively control the continuity of an electrical circuit.

Description of the Prior Art

There are countless examples of electrical switching assemblies known in the art. Specific examples of the prior art are discussed below.

U.S. Pat. No. 4,151,383 relates to a leaf-spring switch comprising an insulating switch base having parallel upper and lower arms each having a claw on the free end, upper and lower leaf springs midway between and in parallel with the arms. The upper leaf spring includes a tongue-shaped projection and a first contact and a terminal while the lower leaf spring includes a plate surrounded by a U-shaped slit larger in width than the upper leaf spring. The finger plate includes a second contact at one end, the lower leaf spring further including a lug and a terminal. The upper and lower springs are fixed by the switch base so that the first and second contacts face each other. A semicircular toggle spring including a forked part which engages the lug and a narrow section smaller in width than the U-shaped slit. The narrow section of the toggle spring includes a slit which engages the tongue-shaped projection of the upper leaf spring wherein the combined spring forces of the upper and lower leaf springs and the toggle spring create a very rapid on-off action.

U.S. Pat. No. 7,710,283 describes a fluid-level sensing device employing the interaction of a first magnet attached to the distal end of an external micro switch arm and a second magnet positioned within the distal end of a pivoting float body to close a circuit within the micro switch to generate a shut-off signal to stop fluid production. A single housing holds the micro switch and float body wherein magnetic forces acting through the housing wall between them and other magnet-positioning materials that separate the two magnets cause signal production. After float body deployment, manual reset of the float body is accomplished through its lever-like distal end. The main body of the micro switch which it is snap-fit into a fixed position within the upper housing chamber for use is entirely encapsulated in waterproof material to protect it from corrosion.

U.S. Pat. Nos. 6,992,260 and 7,067,749 teach a float switch, housing, and clamping member assembly including a wide float switch body for enhanced water displacement that results in a more responsive operation, a housing configured to protect the float switch body from malfunction due to airborne debris, the clamping member configured to create a J-shaped slot with the housing when connected together over the upper edge of a support surface such as a condensate collection pan with a flange.

U.S. Pat. No. 1,889,259 discloses an electrical snap switch including a molded insulating base having a recess, a rib formed integrally with a bottom wall of the recess having a flat surface located above the bottom wall. Lower and upper resilient stationary contacts are located within the recess and biased above and below the plane of the flat surface. A relatively thin flat insulating member is slidable disposed on the flat surface and interposed between the stationary contacts. The insulating member includes a conducting element movable into and out of bridging relation relative to the contacts.

U.S. Pat. No. 2,798,127 shows a snap action mechanism comprising supporting means, a manually operable actuating member movably supported by the supporting means, driving means movably supported by the supporting means and operatively connected to the actuating member for actuation thereby, driven means movably supported by the supporting means. The driven means includes at least two idle positions. A holding means is supported by the supporting means tending to hold the driven means in any of the idle positions. Means carried by the driving means acting on the holding means overcomes the holding tendency upon predetermined movement of the driving means. The means acting on the holdings means includes a cam on the driving member. Positive moving means including a stop terminating the cam and engageable with the driven member and resilient means means acting between the driving means and the driven means and acting upon movement of the driving means snaps the driven means from one another of the positions when the holding tendency is overcome and the positive means carried by the driving means effecting positive movement of the driven means by the driving means by movement beyond their normal relative movement.

U.S. Pat. No. 3,008,024 relates to a toggle switch mechanism comprising a U-shaped sheet material base having a pair of legs and a bight a switch mounted between the legs of the base adjacent the ends thereof opposite the bight, the switch includes an operating member projecting toward the bight lever pivoted between the legs on a pivot adjacent to one end of the lever and located to one side of the operating member engages near the longitudinal center thereof by the operating member. A rocking lever pivoted between the legs on the opposite side of the first lever relative to the switch and having a flange on one end of the rocking lever directed toward the first lever and engageable with the end thereof opposite from the pivot of the first mentioned lever. A handle projecting through the bight and pivoted intermediate its ends on said base has manually engageable end disposed outside of the base and includes a spring loaded end within the base engaging the rocking lever and positioned to move on either side of a dead center position relative to the pivot of the handle and the rocking lever. The spring loaded end of the handle when one side of the dead center position pivots the rocking lever and urges the flange thereon against the coacting end of the first lever to urge the first lever against the switch operating member. The spring loaded end when on the other side of the dead center position pivots the rocking lever to allow reverse pivoting of the first member and return of the operating lever.

U.S. Pat. No. 7,067,750 discloses a float switch assembly with a protective housing/clamping structure including a thumbscrew positioned between two upper bracing protrusions and external braces/ribs that make it less likely for the two parts of the protective housing to flex relative to one another to provide a more secure connection between the two parts of the housing during use to protect a float switch body within the protective housing for reliable shut-off signal activation when needed.

U.S. Pat. No. 7,967,267 describes a two-piece clamping assembly with an integral rail plate used to rapidly and securely mount a float switch within a fluid collection container for fluid level monitoring. The clamping assembly can be used or mounted on differing wall thickness, dimensions and different upper edge configurations. When the front and back clamping members are joined together over the top edge, lip, or flange of a pan using one centrally located top fastener, and at least one additional fastener is inserted through the back clamping member until it engages the exterior surface of the pan, the pan's upper edge becomes secured within an inverted J-shaped slot formed between the two clamping members. Vertically-extending internal ribs and horizontally-extending projections strengthen the clamping assembly.

While some of the prior art may contain some similarities relating to the present invention, none of them teach, suggested or include all of the advantages and unique features of the invention disclosed hereafter.

SUMMARY OF THE INVENTION

The present invention relates to a magnetic switch assembly to control the flow of electricity to at least one electrical load comprising a toggle bar and a switch actuator each rotatably between a first position and a second position.

A set of magnets including a first or toggle magnet mounted on the toggle bar and a second or switch actuator magnet mounted on the switch actuator such that the magnetic fields selectively interact as the switch actuator is moved from the first position and second position moving the toggle bar from the first position to the second position.

The magnetic switch assembly further includes a set of electrical contacts to selectively supply electricity to an electrical load comprising an upper electrical contact connected or coupled to the electrical load by a first conductor and a lower electrical contact mounted on the toggle bar and connected or coupled to the electrical load by a toggle bar conductor and a conductor coupled to the electrical load.

When the toggle bar is biased in the first position and the switch actuator is in the first position the first or toggle magnet is disposed in spaced relationship relative to the switch actuator magnet having a gap therebetween such that the upper electrical contact and the lower electrical contact engage each other to complete the electrical circuit to the electrical load (not shown).

When the switch actuator is rotated clockwise from the first position to the second position decreasing the gap between the first or toggle magnet and the second or switch actuator magnet the magnetic attraction therebetween increases overcoming the force of a first or toggle bar bias rotating the toggle bar counter-clockwise disengaging the lower electrical contact from the upper electrical contact to create an open electrical circuit between the power source and the electrical load.

Electricity or power is returned to the electrical load by rotating the switch actuator in the counter-clockwise direction thereby increasing the gap between the first or toggle magnet and the second or switch actuator magnet decreasing the magnetic attraction therebetween until the force exerted by the toggle bar bias overcomes the magnet attraction between the first or toggle magnet and the second or switch actuator magnet rotating the toggle bar clockwise until the upper electrical contact and the lower electrical contact again engage each other to complete the electrical circuit to the electrical load.

This Summary is not intended to describe essential features of the claimed subject matter nor is it intended to limit the scope of the claimed subject matter. To the contrary, this Summary merely outlines various concepts and features that are developed in the Detailed Description.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
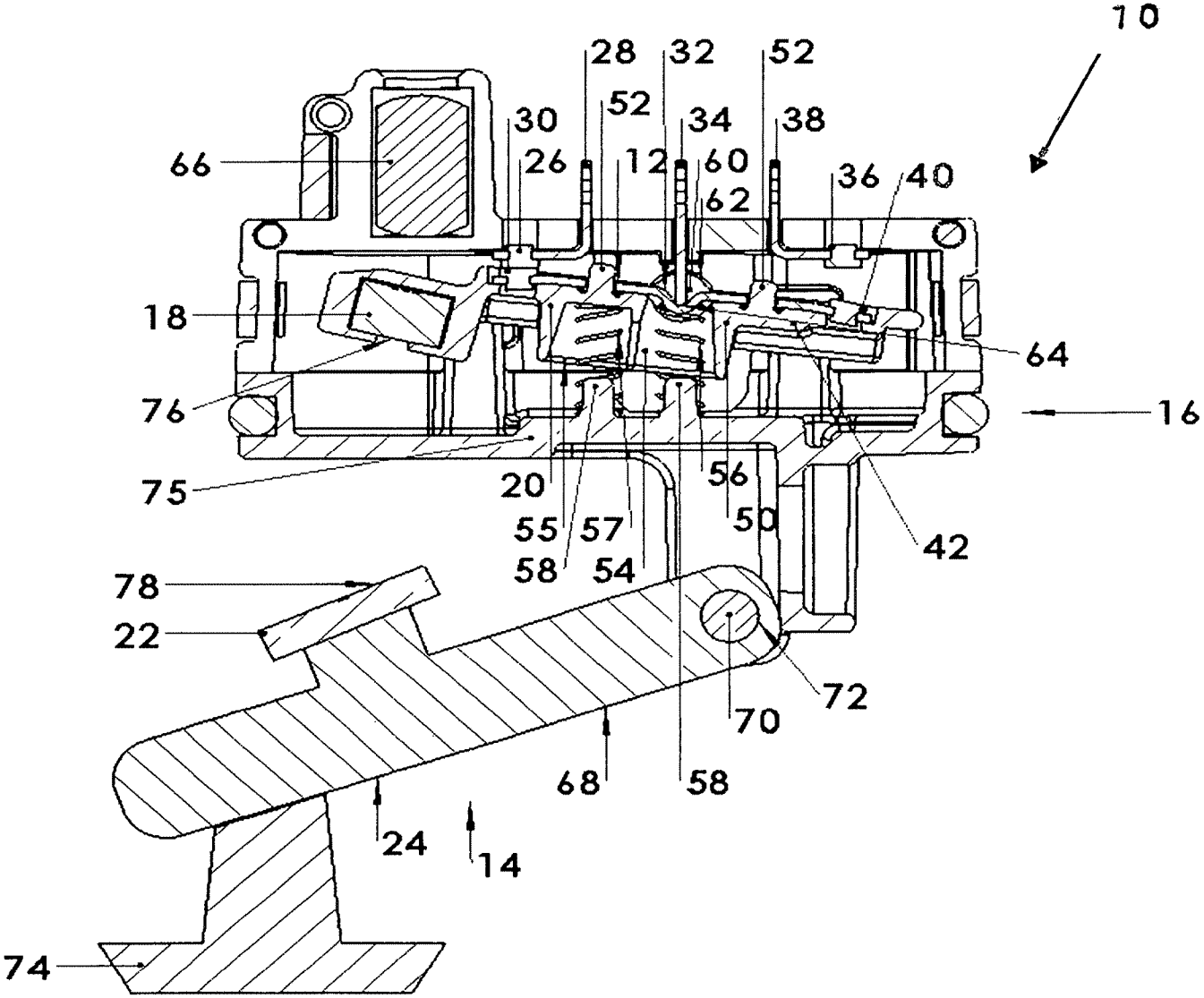
FIG. 1 is a side view of the magnetic switch assembly of the present invention comprising two sets of electrical contacts including a first set of electrical contacts in a closed position and a second set of electrical contacts in an open position.
Figure 2:
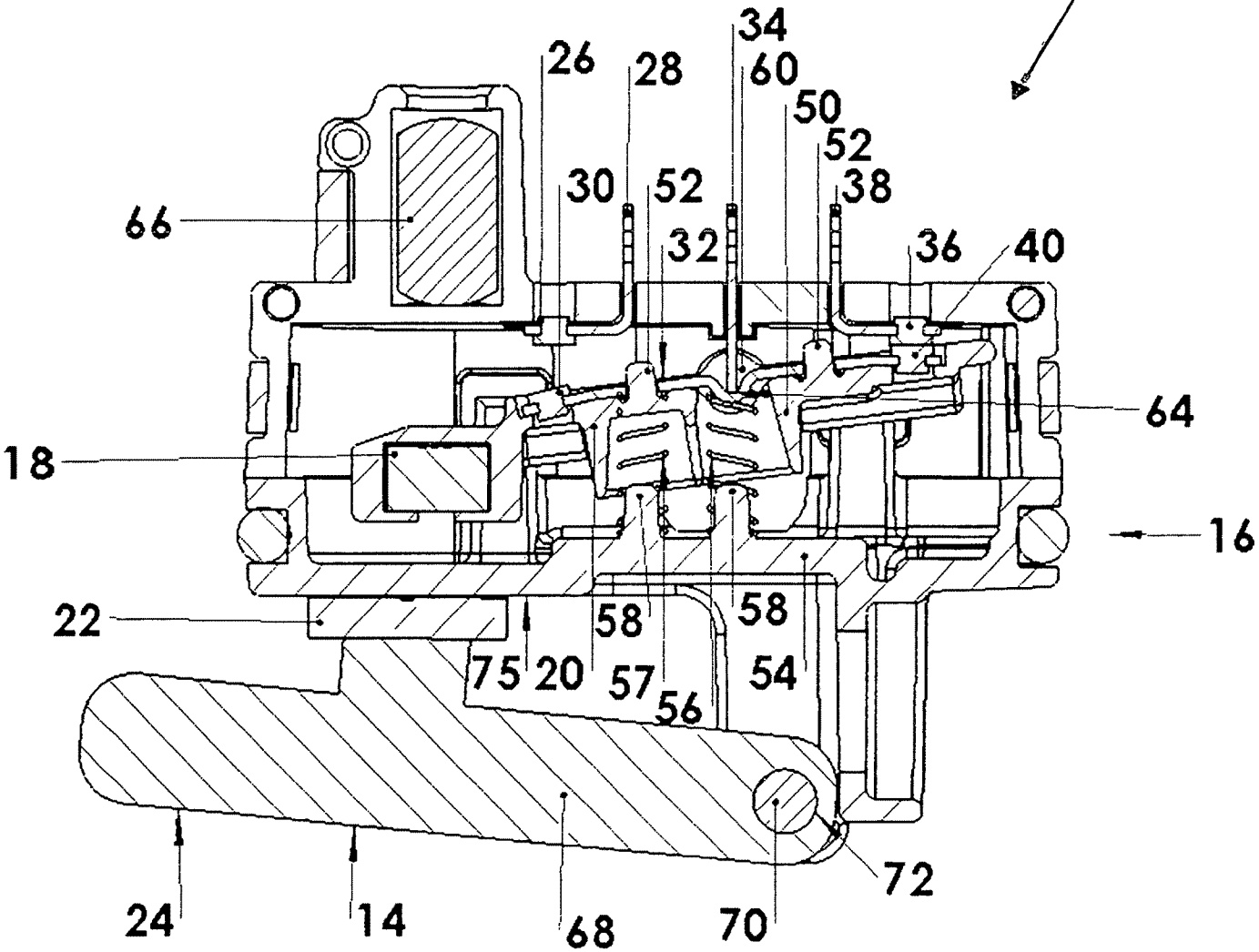
FIG. 2 is a side view of the magnetic switch assembly of the present invention comprising two sets of electrical contacts with the second set of electrical contacts in the closed position and the first set of electrical contacts is in the open position.

As shown in FIGS. 1 and 2, the present invention relates to a magnetic switch assembly generally indicated as 10 to control the flow of electricity to a pair of electrical loads (not shown).

The magnetic switch assembly 10 comprises a toggle bar generally indicated as 12 and a switch actuator generally indicated as 14 each rotatably between a first position (FIG. 1) and a second position (FIG. 2) coupled to a base generally indicated as 16.

A set of magnets includes a first or toggle magnet 18 mounted on the proximal end portion 20 of the toggle bar 12 and a second or switch actuator magnet 22 mounted on the proximal end portion 24 of the switch actuator 14.

The magnetic switch assembly 10 further includes a first set of electrical contacts to selectively supply electricity to a first electrical load (not shown) and a second set of electrical contacts to selectively supply electricity to a second electrical load (not shown). The first set of electrical contacts comprises a first upper electrical contact 26 connected or coupled to the first electrical load (not shown) by a first conductor 28 mounted on the base 16 and a first lower electrical contact 30 mounted on the proximal end portion 20 of the toggle bar 12 and selectively connected or coupled to the first electrical load (not shown) by a toggle bar conductor 32 mounted on the toggle bar 12 and a conductor 34 coupled to the first electrical load (not shown) when the toggle bar 12 and the switch actuator 14 are each in the first position. The second set of electrical contacts comprises a second upper electrical contact 36 connected or coupled to the second electrical load (not shown) by a second conductor 38 mounted on the base 16 and a second lower electrical contact 40 mounted on the distal end portion 42 of the toggle bar 12 and selectively connected or coupled to the second electrical load (not shown) by the toggle bar conductor 32 mounted on the toggle bar 12 and the conductor 34 coupled to the second electrical load (not shown) when the toggle bar 12 and the switch actuator 14 are each in the second position.

Figure 6:
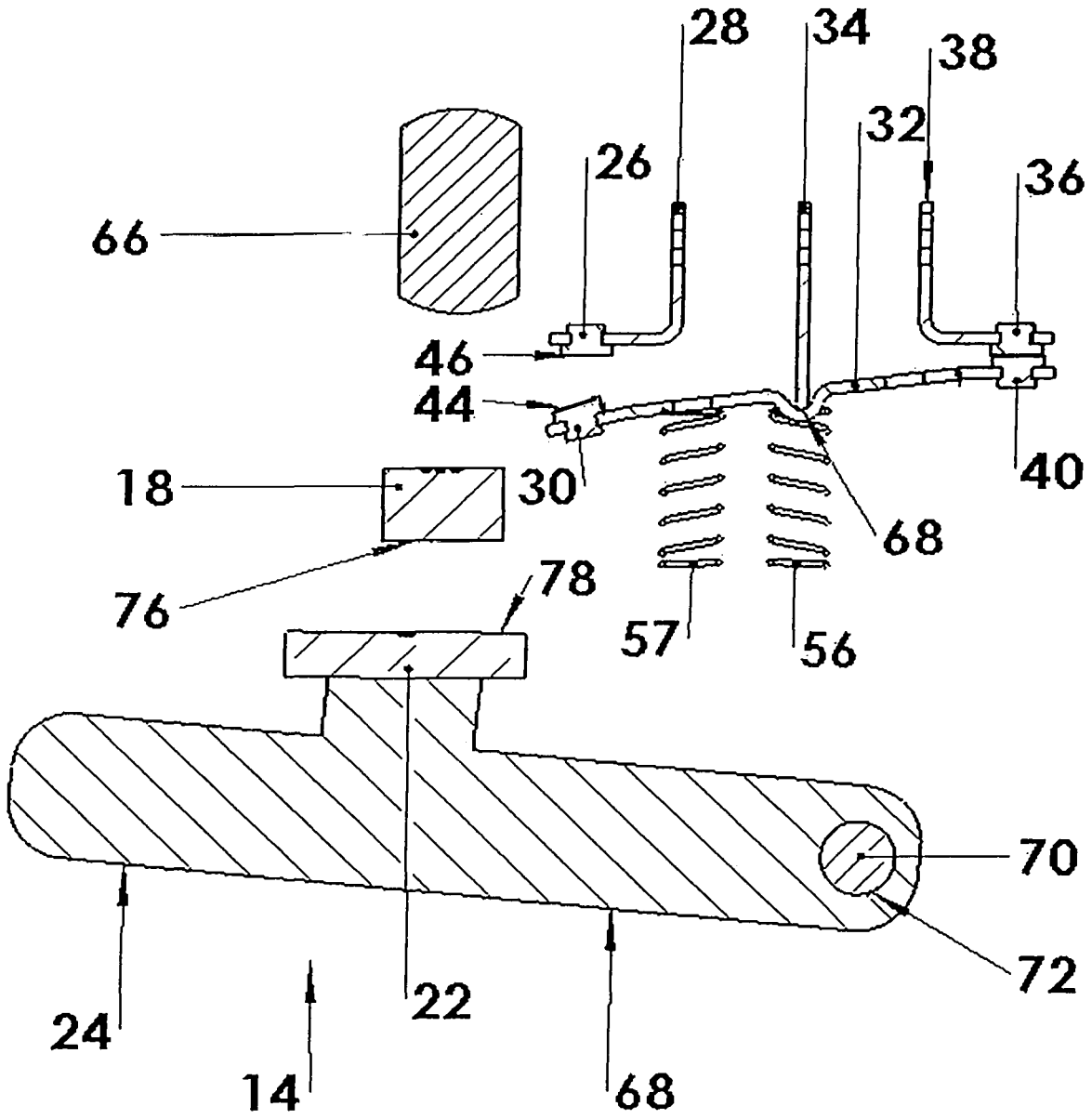
FIG. 6 is a schematic view of the magnetic switch assembly of the present invention comprising two sets of electrical contacts with the second set of electrical contacts in the closed position to supply electricity to an electrical load and the first set of electrical contacts in an open position.

As shown in FIG. 6, the substantially flat upper surface 44 of the first lower electrical contact 30 is inclined downwardly relative to the longitudinal axis LL of the toggle bar 12 toward the proximal end portion 20 of the toggle bar 12 (FIGS. 1 and 2) such that the substantially flat upper surface 44 of the first lower electrical contact 30 engages a substantially flat lower surface 46 of the first upper electrical contact 26 when the toggle bar 12 and the switch actuator 14 are each in the first position (FIG. 1) to complete the first electrical circuit through the first conductor 28, first upper electrical contact 26, first lower electrical contact 30, toggle bar conductor 32 and conductor 34 to the first electrical load (not shown).

Figure 5:
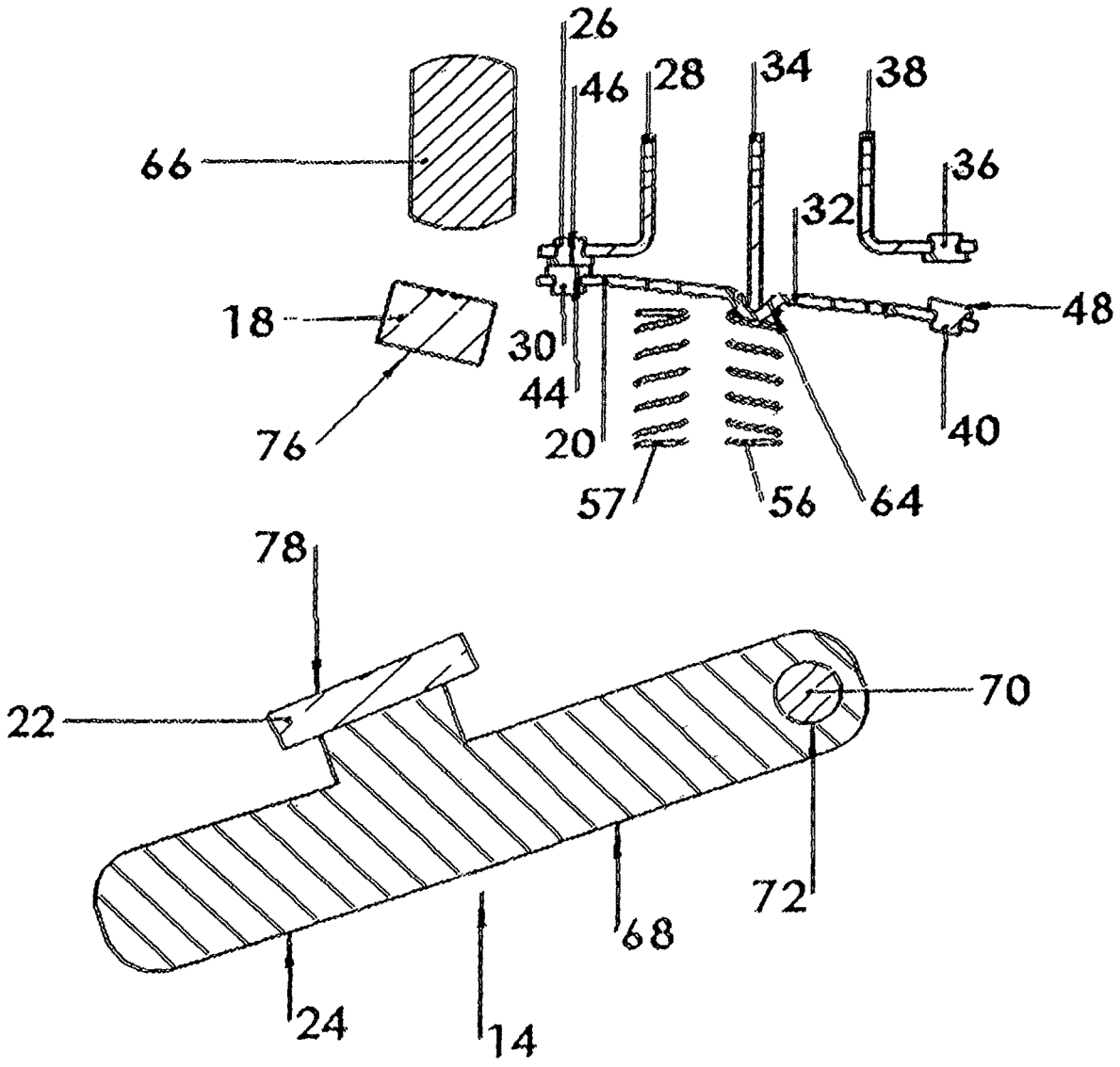
FIG. 5 is a schematic view of the magnetic switch assembly of the present invention comprising two sets of electrical contacts with a first set of electrical contacts in a closed position to supply electricity to an electrical load and a second set of electrical contacts in an open position.

As shown in FIG. 5, the substantially flat upper surface 48 of the second lower electrical contact 40 is inclined downwardly relative to the longitudinal axis LL of the toggle bar 12 toward the distal end portion 42 of the toggle bar 12 (FIGS. 1 and 2) such that the substantially flat upper surface 48 of the second lower electrical contact 40 engages a substantially flat lower surface 50 of the second upper electrical contact 36 when the toggle bar 12 and the switch actuator 14 are each in the second position (FIG. 2) to complete the second electrical circuit through the second conductor 38, second upper electrical contact 36, second lower electrical contact 40, toggle bar conductor 32 and conductor 34 to the second electrical load (not shown).

As shown in FIGS. 1 and 2, the toggle bar 12 comprises a toggle member or block 50 including a pair of upper mounting posts each indicated as 52 to secure to the toggle bar conductor 32 to the toggle member or block 50 and a first lower recess and a second lower recess indicated as 54 and 55 respectively to receive a first toggle bar bias 56 such as a spring and a second toggle bar bias 57 such as a spring each mounted on a corresponding retainer post 58. The toggle bar 32 is rotatably held in position on a pivot member or post 60 extending through an aperture 62 when engaging a concave detent 64 formed on the midportion of the toggle bar 32 by the first or toggle bias 56 mounted or held in place on the corresponding retainer post 58.

As shown in FIGS. 1 and 5, the toggle bar 12 is normally biased in the first position by the second toggle bar bias 57 mounted on the corresponding retainer post 58 and a secondary toggle bar retention member or bias 66 such that the substantially flat surface 44 of the first lower electrical contact 30 engages the substantially flat surface 46 of the first upper electrical contact 26. The secondary toggle bar retention member or bias 66 is mounted or attached to the base 16 to attract the first or toggle magnet 18 as an additional force to retain the toggle bar 12 in the first position when the switch actuator 14 is in the first position. The secondary toggle bar retention member or bias 66 may comprise any metal or other magnetic attracting material.

The distal end portion 68 of the switch actuator 14 is rotatably mounted on a post or pin 70 mounted or formed on the base 16 extending through an aperture 72. Rotation of the switch actuator 14 is limited in a counter-clockwise direction by a first or lower switch actuator stop or limit 74 when in the first position (FIG. 1) and in a clockwise direction by a second or upper switch actuator stop or limit 75 when in the second position (FIG. 2).

As best shown in FIGS. 5 and 6, the lower surface 76 of the first or toggle magnet 18 is inclined downwardly relative to the longitudinal axis LL of the toggle bar 12 toward the conductor 34 or rotation point, pivot member or post 60 and the upper surface 78 of the second or switch actuator magnet 22 is inclined downwardly relative to the toggle bar 12 away from the conductor 34 or rotation point, pivot member or post 60.

As shown in FIGS. 1 and 5, when the toggle bar 12 is biased in the first position and the switch actuator 14 is in the first position, the first or toggle magnet 18 is disposed in spaced relationship relative to the switch actuator magnet 22 having a gap therebetween such that the first upper electrical contact 26 and the first lower electrical contact 30 engage each other to complete the electrical circuit to the first electrical load (not shown). At the same time, the second upper contact 36 and the second lower contact 40 are disposed in spaced relationship to create a gap therebetween to create an open electrical circuit with the second electrical load (not shown).

As shown in FIGS. 2 and 6, when the switch actuator 14 is rotated clockwise from the first position to the second position decreasing the gap between the first or toggle magnet 18 and the second or switch actuator magnet 22 thereby increasing the magnetic attraction therebetween to overcome the bias force of the first or toggle bar bias 56 and the secondary toggle bar retention member or bias 66 disengaging the first lower electrical contact 30 from the first upper electrical contact 26 to create an open electrical circuit with the first electrical load (not shown).

When the toggle bar 12 has rotated to the second position due to the magnetic attraction between the first or toggle magnet 18 and the second or switch actuator magnet 22, the lower surface 78 of the first or toggle magnet 18 and the upper surface 80 of the second or switch actuator magnet 22 are substantially parallel to each other and the second lower electrical contact 40 engages the second upper electrical contact 36 completing the electrical circuit with the second electrical load (not shown).

Engagement of the second upper electrical contact 36 with the second lower electrical contact 40 limits the counter-clockwise rotation of the toggle bar 12 when the switch actuator 14 is rotated clockwise from the first position to the second position.

Electricity is returned to the first electrical load (not shown) by rotation of the switch actuator 14 in the counter-clockwise direction thereby increasing the gap between the first or toggle magnet 18 and the second or switch actuator magnet 22 decreasing the magnetic attraction therebetween until the force exerted by the toggle bar bias 57 overcomes the magnet attraction between the first or toggle magnet 18 and the second or switch actuator magnet 22 rotating the toggle bar 12 clockwise until the first upper electrical contact 24 and the first lower electrical contact 30 again engage each other to complete the electrical circuit to the first electrical load (not shown).

Figure 3:
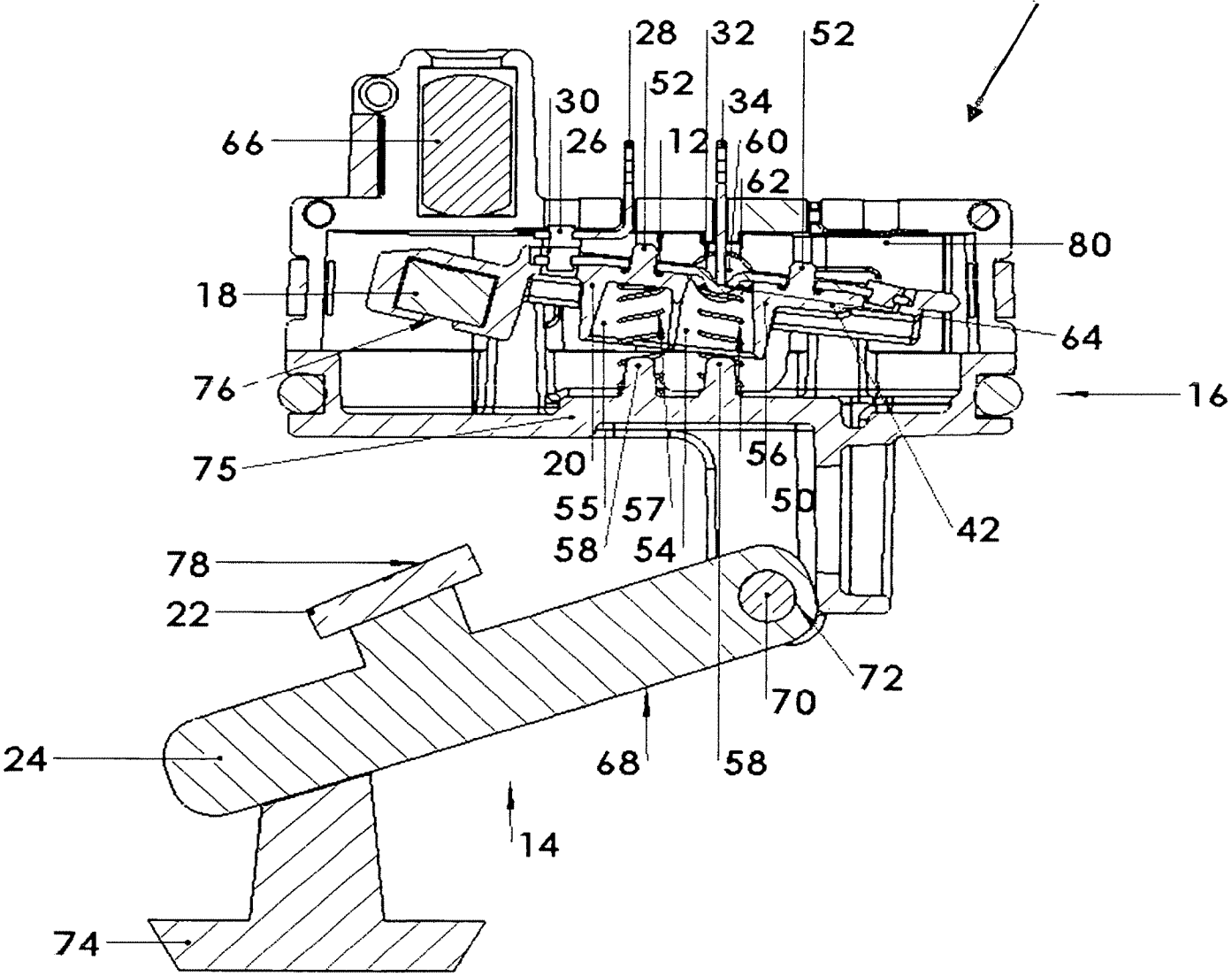
FIG. 3 is a side view of an alternate embodiment of the magnetic switch assembly of the present invention comprising a single set of electrical contacts in a normally closed position to supply electricity to an electrical load.
Figure 4:
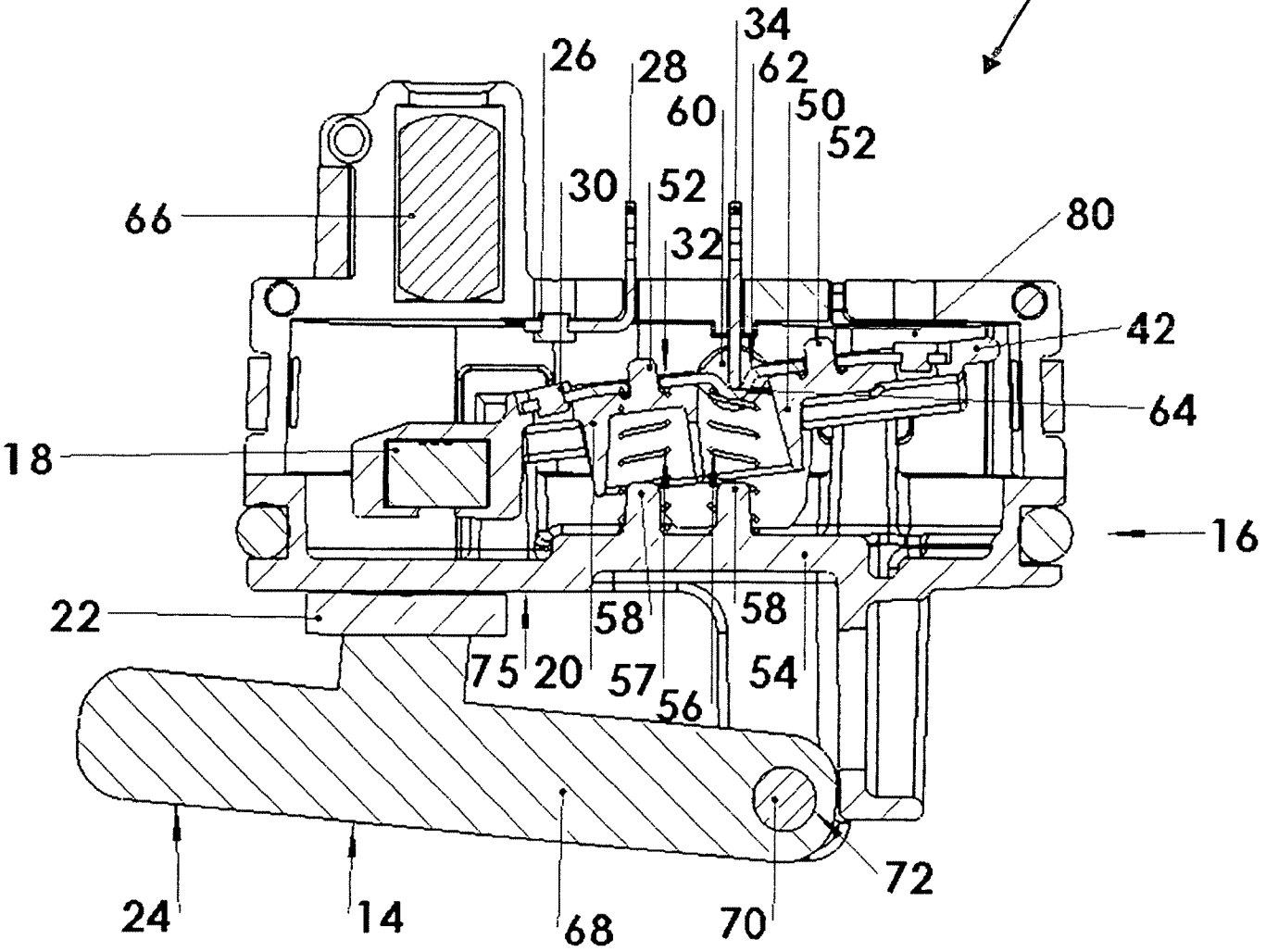
FIG. 4 is a side view of an alternate embodiment of the magnetic switch assembly of the present invention shown in FIG. 3 comprising the single set of electrical contacts in the open position.

FIGS. 3 and 4 show an alternate embodiment of the magnetic switch assembly generally indicated as 10 to control the flow of electricity to a single electrical load (not shown).

The magnetic switch assembly 10 comprises a toggle bar generally indicated as 12 and a switch actuator generally indicated as 14 each rotatably between a first position (FIG. 3) and a second position (FIG. 4) coupled to a base generally indicated as 16.

A set or pair of magnets includes a first or toggle magnet 18 mounted on the proximal end portion 20 of the toggle bar 12 and a second or switch actuator magnet 22 mounted on the proximal end portion 24 of the switch actuator 14.

The magnetic switch assembly 10 further includes a set of electrical contacts to selectively supply electricity to a first electrical load (not shown) comprising an upper electrical contact 26 connected or coupled to the electrical load (not shown) by a first conductor 28 mounted on the base 16 and a lower electrical contact 30 mounted on the proximal end portion 20 of the toggle bar 12 and selectively connected or coupled to the electrical load (not shown) by a toggle bar conductor 32 mounted on the toggle bar 12 and a second conductor 34 coupled to the electrical load (not shown) when the toggle bar 12 and the switch actuator 14 are each in the first position.

As shown in FIG. 6, the substantially flat upper surface 44 of the lower electrical contact 30 is inclined downwardly relative to the longitudinal axis LL of the toggle bar 12 toward the proximal end portion 20 of the toggle bar 12 (FIGS. 3 and 4) such that the substantially flat upper surface 44 of the lower electrical contact 30 engages a substantially flat lower surface 46 of the upper electrical contact 26 when the toggle bar 12 and the switch actuator 14 are each in the first position (FIG. 1) to complete the first electrical circuit through the first conductor 28, upper electrical contact 26, lower electrical contact 30, toggle bar conductor 32 and conductor 34 to the electrical load (not shown).

As shown in FIGS. 3 and 4, the toggle bar 12 comprises a toggle member or block 50 including a pair of upper mounting posts each indicated as 52 to secure to the toggle bar conductor 32 to the toggle member or block 50 and a first lower recess and a second lower recess indicated as 54 and 55 respectively to receive a first toggle bar bias 56 such as a spring and a second toggle bar bias 57 such as a spring each mounted on a corresponding retainer post 58. The toggle bar 32 is rotatably held in position on a pivot member or post 60 extending through an aperture 62 when engaging a concave detent 64 formed on the midportion of the toggle bar 32 by the first toggle bar bias 56 mounted or held in place on the corresponding retainer post 58.

As shown in FIGS. 3 and 5, the toggle bar 12 is biased in the first position by the second toggle bar bias 57 mounted on the corresponding retainer post 58 and a secondary toggle bar retention member or bias 66 such that the substantially flat surface 44 of the lower contact 30 engages the substantially flat surface 46 of the upper contact 26. The secondary toggle bar retention member or bias 66 is mounted or attached to the base 16 to attract the first or toggle magnet 18 as an additional force to retain the toggle bar 12 in the first position when the switch actuator 14 is in the first position. The secondary toggle bar retention member or bias 66 may comprise any metal or other magnetic attracting material.

The distal end portion 68 of the switch actuator 14 is rotatably mounted on a post or pin 70 mounted or formed on the base 16 extending through an aperture 72. Rotation of the switch actuator 14 is limited in a counter-clockwise direction by a first or lower switch actuator stop or limit 74 when in the first position (FIG. 3) and in a clockwise direction by a second or upper switch actuator stop or limit 75 when in the second position (FIG. 4).

As best shown in FIGS. 5 and 6, the lower surface 76 of the first or toggle magnet 18 is inclined downwardly relative to the longitudinal axis LL of the toggle bar 12 toward the conductor 34 or rotation point, pivot member or post 60 and the upper surface 78 of the second or switch actuator magnet 22 is inclined downwardly relative to the toggle bar 12 away from the conductor 34 or rotation point, pivot member or post 60.

As shown in FIGS. 3 and 5, when the toggle bar 12 is biased in the closed or first position and the switch actuator 14 is in the first position, the first or toggle magnet 18 is disposed in spaced relationship relative to the switch actuator magnet 22 having a gap therebetween such that the upper electrical contact 26 and the lower electrical contact 30 engage each other to complete the electrical circuit to the electrical load (not shown).

As shown in FIGS. 4 and 6, when the switch actuator 14 is rotated clockwise from the first position to the second position decreasing the gap between the first or toggle magnet 18 and the second or switch actuator magnet 22 thereby increasing the magnetic attraction therebetween to overcome the bias force of the first or toggle bar bias 56 and the secondary toggle bar retention member or bias 66 disengaging the lower electrical contact 30 from the upper electrical contact 26 to create an open electrical circuit with the electrical load (not shown).

Engagement of the distal end portion 42 of the toggle bar 12 engages an upper toggle bar stop or limit 80 to limit the counter-clockwise rotation of the toggle bar 12 when the switch actuator 14 is rotated clockwise from the first position to the second position.

When the toggle bar 12 has rotated to the second position, the lower surface 78 of the first or toggle magnet 18 and the upper surface 80 of the second or switch actuator magnet 22 are substantially parallel to each other.

Electricity is returned to the electrical load (not shown) by rotation of the switch actuator 14 in the counter-clockwise direction thereby increasing the gap between the first or toggle magnet 18 and the second or switch actuator magnet 22 decreasing the magnetic attraction therebetween until the force exerted by the toggle bar bias 57 overcomes the magnet attraction between the first or toggle magnet 18 and the second or switch actuator magnet 22 rotating the toggle bar 12 clockwise until the upper electrical contact 24 and the lower electrical contact 30 again engage each other to complete the electrical circuit to the electrical load (not shown).

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

In describing the invention, certain terms are used for brevity, clarity, and understanding. No unnecessary limitations should be inferred beyond the requirement of the prior art because such terms are used for descriptive purposes and are intended to be broadly construed. The different structural and functional elements, apparatuses, devices, compositions, and methods described herein may be used alone or in combination with other structural and functional elements, apparatuses, devices, compositions, systems and methods. It is to be expected that various equivalents, alternatives and modifications are possible within the scope of the claims hereinafter.

What is claimed is:

1. A magnetic switch assembly to selectively control the flow of electricity to a first electrical load or a second electrical load comprising a toggle bar and a switch actuator each rotatably a between a first position and a second position coupled to a base, a toggle magnet mounted on a proximal end portion of said toggle bar and a switch actuator magnet mounted on a proximal end portion of said switch actuator, said magnetic switch assembly further includes a first set of electrical contacts to selectively supply electricity to the first electrical load and a second set of electrical contacts to selectively supply electricity to the second electrical load, said first set of electrical contacts comprises a first upper electrical contact coupled to the first electrical load by a first conductor and a first lower electrical contact mounted on said proximal end portion of said toggle bar and selectively coupled to the first electrical load by a toggle bar conductor mounted on said toggle bar and a conductor coupled to said first electrical load when said toggle bar and said switch actuator are each in said first position and said second set of electrical contacts comprises a second upper electrical contact coupled to the second electrical load by a second conductor and a second lower electrical contact mounted on a distal end portion of said toggle bar and selectively coupled to the second electrical load by said toggle bar conductor mounted on said toggle bar and said conductor coupled to the second electrical load when said toggle bar and said switch actuator are each in said second position wherein when said toggle bar is biased in said first position by a toggle bar bias and said switch actuator is disposed in said first position, said toggle magnet is disposed in spaced relationship relative to said switch actuator magnet having a gap therebetween when said toggle bar and said switch actuator are each in said first position such that said first upper electrical contact and said first lower electrical contact engage each other to complete the electrical circuit to the first electrical load said second upper contact and said second lower contact are disposed in spaced relationship relative to each other to create a gap therebetween to create an open electrical circuit with the second electrical load and wherein when said switch actuator is rotated from said first position to said second position decreasing the gap between said toggle magnet and said switch actuator magnet thereby increasing the magnetic attraction therebetween to overcome the bias of said toggle bar bias disengaging said first lower electrical contact from said first upper electrical contact to create an open electrical circuit with the first electrical load and when said toggle bar has rotated to said second position due to the magnetic attraction between said toggle magnet said switch actuator magnet, said second lower electrical contact engages said second upper electrical contact completing the electrical circuit with the second electrical load, said toggle bar comprises a toggle member including at least one upper mounting post to secure said toggle bar conductor to said toggle member and a recess to receive said toggle bar bias mounted on a retainer post to bias said toggle bar in said first position.

2. The magnetic switch assembly of claim 1 wherein said first lower electrical contact includes an upper surface inclined downwardly relative to the longitudinal axis of said toggle bar toward said proximal end portion of said toggle bar to engage said first upper electrical contact when said toggle bar and said switch actuator are each in said first position to complete the electrical circuit to the first electrical load and second lower electrical contact includes an upper surface inclined downwardly relative to the longitudinal axis of said toggle bar toward said proximal end portion of said toggle bar to engage said second upper electrical contact when said toggle bar and said switch actuator are each in said second position to complete the electrical circuit to said second electrical load.

3. The magnetic switch assembly of claim 1 wherein said toggle bar is rotatably held in position on a pivot post extending through an aperture when engaging a concave detent formed on a midportion of said toggle bar by a toggle bias mounted on a corresponding retainer post.

4. The magnetic switch assembly of claim 1 further including a second toggle retention member mounted to said base and disposed to attract said toggle magnet to retain said toggle bar in said first position when said switch actuator is in said first position.

5. The magnetic switch assembly of claim 1 wherein said toggle magnet includes a lower surface inclined downwardly relative to a longitudinal axis of said toggle bar toward said distal end portion relative to said toggle bar and said switch actuator magnet includes an upper surface inclined downwardly relative to said proximal end portion relative to said switch actuator.

6. The magnetic switch assembly of claim 5 wherein said lower surface of said first magnet and said upper surface of said second magnet are substantially parallel to each other when said toggle bar and said switch actuator and each in said second position.

7. The magnetic switch assembly of claim 1 wherein rotation of said switch actuator is limited in a counterclockwise direction by a lower switch actuator limit when in said first position and in a clockwise direction by an upper switch actuator limit when in said second position.

8. The magnetic switch assembly of claim 1 wherein said toggle magnet includes a lower surface and said switch actuator magnet includes an upper surface wherein said lower surface of said toggle magnet and said upper surface of said switch actuator magnet are inclined relative to each other when said toggle bar and said switch are each in said first position.

9. A magnetic switch assembly to selectively control the flow of electricity to a first electrical load or a second electrical load comprising a toggle bar and a switch actuator each rotatably a between a first position and a second position coupled to a base, a toggle magnet including a lower surface mounted on a proximal end portion of said toggle bar and a switch actuator magnet including an upper surface mounted on a proximal end portion of said switch actuator, said magnetic switch assembly further includes a first set of electrical contacts to selectively supply electricity to the first electrical load and a second set of electrical contacts to selectively supply electricity to the second electrical load, said first set of electrical contacts comprises a first upper electrical contact coupled to the first electrical load by a first conductor and a first lower electrical contact mounted on said proximal end portion of said toggle bar and selectively coupled to the first electrical load by a toggle bar conductor mounted on said toggle bar and a conductor coupled to said first electrical load when said toggle bar and said switch actuator are each in said first position and said second set of electrical contacts comprises a second upper electrical contact coupled to the second electrical load by a second conductor and a second lower electrical contact mounted on a distal end portion of said toggle bar and selectively coupled to the second electrical load by said toggle bar conductor mounted on said toggle bar and said conductor coupled to the second electrical load when said toggle bar and said switch actuator are each in said second position wherein when said toggle bar and said switch actuator are each in said first position, said toggle magnet is biased in spaced relationship relative to said switch actuator magnet of opposite polarity by a toggle bar bias to maintain a gap therebetween such that said first upper electrical contact and said first lower electrical contact engage each other to complete the electrical circuit to the first electrical load and said second upper contact and said second lower contact are disposed in spaced relationship relative to each other to create an open electrical circuit with the second electrical load and wherein when said switch actuator is rotated upwardly from said first position to said second position decreasing the gap between said toggle magnet and said switch actuator magnet thereby increasing the magnetic attraction therebetween to overcome the bias of said toggle bar bias rotating said toggle bar downward as said switch actuator magnet rotate upward disengaging said first lower electrical contact from said first upper electrical contact to create an open electrical circuit with the first electrical load and as said toggle bar rotates downward to said second position due to the magnetic attraction between said toggle magnet and said switch actuator magnet, said second lower electrical contact engages said second upper electrical contact completing the electrical circuit with the second electrical load.

10. The magnetic switch assembly of claim 9 wherein said toggle bar comprises a toggle member to support said toggle bar conductor.

11. The magnetic switch assembly of claim 10 wherein said toggle bar bias comprises a spring disposed to engage said toggle member to bias said toggle bar in said first position when said switch actuator is in said first position.

12. The magnetic switch assembly of claim 11 wherein said toggle member includes at least one upper mounting post to secure to said toggle bar conductor to said toggle member and a recess to receive said spring mounted on a retainer post to bias said toggle bar in said first position.

13. The magnetic switch assembly of claim 11 further including a second toggle bias disposed to bias said toggle magnet to retain said toggle bar in said first position when said switch actuator is in said first position.

14. The magnetic switch assembly of claim 13 wherein said second toggle bias comprises a magnetically attracted member disposed above said proximal end portion of said toggle bar.

15. The magnetic switch assembly of claim 13 wherein said toggle bar is rotatably held in position on a pivot post engaging a concave detent formed on a midportion of said toggle bar by a toggle bias mounted on a corresponding retainer post.

16. The magnetic switch assembly of claim 9 wherein said toggle bar is rotatably held in position on a pivot post engaging a concave detent formed on a midportion of said toggle bar by a toggle bias mounted on a corresponding retainer post.

17. The magnetic switch assembly of claim 9 further including a second toggle bias disposed to bias said toggle magnet to retain said toggle bar in said first position when said switch actuator is in said first position.

18. The magnetic switch assembly of claim 17 wherein said toggle bar bias comprises a spring disposed to engage said toggle member to bias said toggle bar in said first position when said switch actuator is in said first position and said second toggle bias comprises a magnetically attracted member disposed above said proximal end portion of said toggle bar.

19. The magnetic switch assembly of claim 9 wherein said lower surface of said toggle magnet and said upper surface of said switch actuator magnet are substantially parallel.

* * * * *